US009339437B2

(12) United States Patent
Isibor et al.

(10) Patent No.: US 9,339,437 B2
(45) Date of Patent: May 17, 2016

(54) MEDICINAL STORAGE, SAFETY, ORGANIZATIONAL AND DELIVERY DEVICE

(71) Applicant: Atlantic Health System, Inc., Morristown, NJ (US)

(72) Inventors: Jefferson Isibor, Summit, NJ (US); Yanira Castelan, Summit, NJ (US); Heather Gucwa, Summit, NJ (US)

(73) Assignee: Atlantic Health System, Inc., Morristown, NJ (US)

( * ) Notice: Subject to any disclaimer, the term of this patent is extended or adjusted under 35 U.S.C. 154(b) by 0 days.

(21) Appl. No.: 14/511,147

(22) Filed: Oct. 9, 2014

(65) Prior Publication Data

US 2016/0101018 A1 Apr. 14, 2016

(51) Int. Cl.

| | |
|---|---|
| ***B65D 25/54*** | (2006.01) |
| ***A61J 1/06*** | (2006.01) |
| ***A61J 1/14*** | (2006.01) |
| ***B65D 25/10*** | (2006.01) |
| ***B65D 43/02*** | (2006.01) |

(52) U.S. Cl.

CPC *A61J 1/06* (2013.01); *A61J 1/1412* (2013.01); *B65D 25/108* (2013.01); *B65D 25/54* (2013.01); *B65D 43/0204* (2013.01); *A61J 2205/10* (2013.01); *B65D 2543/00592* (2013.01)

(58) Field of Classification Search

CPC ..... A47F 1/04; A47F 7/28; A61J 1/00; A61J 1/1412; A61J 2205/30; B65D 25/54; B65D 25/108; B65D 43/024; B65D 2543/00592; B65D 43/24

USPC ..... 206/1.5, 427, 459.5, 534, 807; 211/74; 312/236

See application file for complete search history.

(56) References Cited

U.S. PATENT DOCUMENTS

| | | | | | |
|---|---|---|---|---|---|
| 1,581,749 | A * | 4/1926 | Mahony | A47B 31/02 | 312/236 |
| 3,148,515 | A | 9/1964 | Jentis | | |
| 3,204,759 | A * | 9/1965 | Palmer | B65D 5/42 | 206/459.5 |
| 3,380,574 | A * | 4/1968 | De Kerland | A47F 7/283 | 206/779 |
| 3,716,133 | A * | 2/1973 | Koebler | B65D 71/10 | 206/459.5 |
| 3,744,661 | A * | 7/1973 | Fischer, Jr. | B65D 1/24 | 206/446 |
| 4,230,226 | A * | 10/1980 | Boe | A45C 13/02 | 206/561 |
| 4,350,253 | A * | 9/1982 | Rusteberg | B01L 9/06 | 211/74 |
| 5,361,907 | A | 11/1994 | Mohrhauser | | |
| 6,164,450 | A * | 12/2000 | Benedetti | A61H 35/02 | 206/570 |
| 6,464,506 | B1 * | 10/2002 | Welles | A61G 12/00 | 206/459.5 |
| 6,529,446 | B1 | 3/2003 | de la Huerga | | |
| 7,607,541 | B2 * | 10/2009 | Girgis | A61J 7/04 | 206/229 |
| 8,006,846 | B2 | 8/2011 | Robertson | | |
| 8,104,618 | B2 * | 1/2012 | Sadler | B65D 5/4216 | 206/45.29 |
| 8,479,919 | B2 * | 7/2013 | Kaplan | B65D 51/002 | 206/438 |

(Continued)

*Primary Examiner* — Bryon Gehman

(74) *Attorney, Agent, or Firm* — The McHattie Law Firm, LLC; Clay D. Shorrock, Esq.; Jack B. Baldini, Esq.

(57) ABSTRACT

A lockable storage container and delivery device is provided that exposes the access port of liquid medicinal vials (such as for insulin) while maintaining identification, security, organization and inventory data access, for easy and documented administration of such medicine. The container has individual compartments for various types of medication, or variants of a similar medication (such as various types of insulin) in one convenient and secure container that provides optimal, efficient, cost-saving and safe delivery of medicine to patients.

11 Claims, 10 Drawing Sheets

(56) References Cited
U.S. PATENT DOCUMENTS 8,567,640 B1 * 10/2013 Johnson-Lofton .. G07F 17/0092 211/59.2
2009/0230015 A1 * 9/2009 Harrison ..... B65D 21/0204 206/571
2010/0264058 A1 * 10/2010 Krause ..... B65B 5/024 206/745
2012/0012606 A1 1/2012 Longley

* cited by examiner

MEDICINAL STORAGE, SAFETY, ORGANIZATIONAL AND DELIVERY DEVICE

FIELD OF THE INVENTION

The present invention provides a device that allows medicine vials to be safely and securely stored and organized for optimal, efficient, cost-saving and safe delivery of medicine to patients. Specifically, a lockable storage container is provided that exposes the access port of medicinal vials (such as for insulin and the like) and a means of identification, for example perceptible "scannable" bar codes, for easy and documented administration with unique compartments for various types of medication in one convenient and secure container.

BACKGROUND

In a typical hospital setting, there is often a multi-dose patient specific vial of medication, for example here, insulin. Often, such a multi-dose patient specific vial holds 3 ml to 10 ml, with a single adult dose commonly being 30 Units, or 0.3 ml. Thus, with this example, in such a multi-dose patient specific vial of medication, there will be 10 to 33 doses per vial, or put another way, 10 to 33 opportunities for error or waste. In a hospital setting, each vial will be kept at the nurse's station, in the patient's room, on a medicine cart and sometimes, unfortunately, randomly in a pocket in a nurse's uniform. As result of the foregoing, (a) a multi-dose patient specific vial of medication is often wasted as result of non-use, for example the patient label can fall off or become unreadable, (b) a multi-dose patient specific vial of medication is often lost due to poor handling processes and procedures, (c) a multi-dose patient specific vial of medication is not used because of patient discharge, (d) a multi-dose patient specific vial of medication often expires before full use, (e) a multi-dose patient specific vial of medication may not be fully used due to medication changes. As a result, perfectly good medication, perhaps needed by another patient, becomes unavailable. Moreover, as a result of less than ideal storage means, both (a) the opportunity for error, for example by extracting the incorrect multi-dose patient specific vial of medication from a pocket or bed stand, and (b) the opportunity for non-permitted access, are heightened.

Objectives of the present invention include increasing patient safety; having a more efficient system of dispensing medicines to patients; decreasing the average number of medicine vials needed per patient; securing medications; and adherence to The Joint Commission regulations and standards regarding high alert medications.

To date, the principal safety, storage, organization and delivery devices for medicinal preparations tend to be either patient centric or pharmacy centric and nothing in between or encompassing both. For example, U.S. Pat. No. 3,148,515 titled, INSULIN PRESERVING TRAVEL KIT FOR DIABETICS that issued Sep. 15, 1964 discloses "medicine chests or kits and has particular reference to portable kits containing a temporary supply of insulin and hypodermic injection equipment for use by diabetics while traveling." This is an example of a patient centric solution and does not address the problems incident in hospitals noted above.

In another example, U.S. Pat. No. 6,529,446 titled, "INTERACTIVE MEDICATION CONTAINER that issued Mar. 4, 2003 discloses, "an interactive medication container that hold or otherwise organizes one or more medication vials or containers. Each vial has a memory strip containing medication and prescription information. Each vial can also include a reminder unit that is attached to and portable with the individual vials. The console or reminder unit reads the information strip of the vial and communicates this information to or interacts with a patient to remind them to take the medication. The medication container or reminder unit also gathers or tracks information such as consumption time, quantity remaining, patient feedback, and contraindication information. The medication container or reminder unit interacts with the patient by displaying questions or receiving and recording input from the patient before, during or after a dose of medication is taken. The patient input can be used to modify the dosing regimen for future doses of medication. The medication container reorders medication when the quantity remaining reaches a threshold level. Contraindication information in the memory strip is downloaded to a personal home computer or a hospital or nursing home computer." Again, this is a patient centric solution and does not address the problems incident in hospitals noted above.

In another example, U.S. patent application Ser. No. 13/181,873 titled, "AUTOMATED PHARMACY SYSTEM FOR DISPENSING UNIT DOSES OF PHARMACEUTICALS AND THE LIKE filed Jul. 13, 2011 discloses, "a system for storing and dispensing discrete doses of pharmaceuticals includes: a housing with an internal cavity having a front wall with first and second windows; multiple storage locations positioned within the housing; and a carrier assembly positioned and movable within the housing. The carrier assembly is configured to receive a pharmaceutical dose package loaded into either the first or second window and convey the pharmaceutical dose package to one of the storage locations for storage therein, and is further configured to retrieve a pharmaceutical dose package from one of the storage locations and return the pharmaceutical dose package to the first or second window for dispensing therefrom." This is a pharmacy centric solution that also does not address the problems incident in hospitals noted above.

In another example, U.S. Pat. No. 5,361,907 titled BOX FOR STORING AMPULES that issued Nov. 8, 1994 discloses, "a new type of box for the packaging of ampoules or the like exhibits hollow walls (4 and 5) separated from each other having a triangular shaped cross-section, with lengthwise sidewalls (2 and 3) and a box bottom (1) which are so joined with one another that ampoules (10), or the like, which are stored, in a clamping fashion, in the cutouts of the hollow walls (4 and 5), due to their resilient support, do not come in contact with the bottom of the box (1) even under pressure from above. This construction has, furthermore, the advantage that both ends of the ampoules (10) are free and can easily be gripped with the fingers at these locations to be removed from the box." While this disclosure might satisfy the ability to safely store and transport multiple vials, it is lacking in many important functional aspects of the present invention.

In another example, U.S. Pat. No. 8,006,846 titled PORTABLE MEDICINE CASE that issued Aug. 30, 2011 discloses, "a portable carrying case . . . to hold medicine vials during travel, doctors' visits etc. The case includes an open topped box with a hinged lid and attachment means to secure the lid to the box. The case further includes a vial support platform, which may be the upper surface of the box, or a separate platform attachable to the box bottom wall. The platform has a plurality of spaced, parallel divider walls having lower edges attached to the support surface and upper edges. The divider walls have aligned left holes and aligned right holes. An elastic cord is slidable through aligned holes to cord ends outside an end divider wall. A cord lock is used to adjust the length of the cord. The support surface, walls and cord form a plurality of adjustable vial receiving compartments, with the force on each vial being equal regardless of differences in vial sizes." Similarly, this disclosure might satisfy the ability to safely store and transport multiple vials, it is lacking in many important functional aspects of the present invention.

None of the foregoing references, alone or in combination, teach the salient and essential features of the instant invention. There remains, therefore an unmet need for a device that insures patient safety goals; has a more efficient system of dispensing medicines to patients; decreases the average number of medicine vials needed per patient; secures medications; and advances the goals of The Joint Commission regulations and standards regarding high alert medications by providing a transport storage container capable of securely delivering multiple medicine vials, especially multi-dose vials; exposing the identity of the medication, exposing the access port to the medication, exposing the expiration date of the medication and providing different medications in various specific orientations to minimize risk and increase efficiency. Additionally, bar coding access provides the means to track administration of medication to specific patients.

SUMMARY

The present invention provides a solution to the unmet need, by providing a device comprising a lockable storage container capable of holding a plurality of medicine vials wherein like medications are oriented in a similar direction and different medications are oriented in a different direction; identity of the medication (including an exposed barcode) is readily perceptible; expiration date of the medication is readily perceptible and exposure to the access port of the medication is directly accessible all while the storage container remains locked securing all medications contained therein.

In one embodiment, the device of the present invention comprises a plastic, compartmented case further comprising a lockable hinged top and cutouts in the sidewalls into which the neck of medicinal vials slide securing same within compartments while properly orienting the vial and exposing just the access port and further comprising corresponding cutouts in the bottom exposing bar code identifications on each contained vial and allowing direct access to the expiration date label. In this embodiment, the container is loaded with individual medicine vials by sliding the neck of such vial into the corresponding cutout in the sidewall leaving the access port of the vial exposed on the outside of the container with the rest of the vial secured in an inside compartment. Once all vials are loaded, the top is closed and locked with lock tabs such that the container cannot be opened without breaking the lock tabs and exposing the fact that the container became unlocked. The bottom of the container contains cutouts to directly access bar codes and expiration date labels affixed on the outside of the vials. The container has a plurality of sidewalls and each distinct type of medication loaded into the container is oriented in a similarly distinct sidewall cutout such that each type of medication has its own distinct orientation.

In one embodiment, the medicine vials could be secured within compartments in the storage container with snap in place holders or foldover tabs or the like and expose the access port of the medicine vials through a small cutout in the sidewall.

In one embodiment, the device of the present invention could be made of any suitable material, such as plastic, glass, plexiglass, metal, cardboard and the like. It is a preferred embodiment that the material chosen be substantially see-through such that the vials can be viewed and that the material be sturdy such that the container can be reused and remain secure.

In one embodiment, the device of the present invention is a rectangular shape approximately 8½ inches×2 inches×1 inch and contains four medicine vials. In one embodiment, the device of the present invention is devised to house: two multi-dose vials that are the same medicine and are oriented to be exposed along the sidewall that is 8½ inches and disposed in the middle portion of said wall; one multi-dose vial that is a second medicine and is oriented along an end sidewall that is 2 inches disposed in the middle portion of said wall; and one multi-dose vial that is a third medicine and is oriented along the opposite 2 inch sidewall disposed in the middle portion of said wall.

In one embodiment, the device of the present invention is devised to house insulin multi-dose vials and in the embodiment just described, would house two multi-dose vials of insulin lispro (commonly sold under the brand humaLOG) in the center compartments; one multi-dose vial of insulin glargine (commonly sold under the brand Lantus) along one of the end compartments and one multi-dose vial of regular insulin (commonly sold under the brand HumulinR) along the opposite end compartment.

In one embodiment, the device of the present invention could be substantially triangular and house three multi-dose vials, one mouth exposed at each triangular apex.

In one embodiment, the container could be substantially square and house four multi-dose vials, one mouth exposed at each quadrant angular apex.

In one embodiment, the cover for device of the present invention could slide on and off through the use of tracks.

In one embodiment, the locking mechanism could comprise a small padlock that could secure the cover to the base of the device of the present invention through corresponding aligned semi-circular or other tabs.

In one embodiment, the locking mechanism could comprise a tamper evident label.

In one embodiment, the locking mechanism could comprise a security pull tie or cable tie.

In one embodiment, the top cover could be a snap in place cover or a magnetic cover or a hook and loop fastened cover.

In one embodiment, the locking mechanism is a push tab that snaps into place into an opening or slot through the cover with a corresponding aligned opening or slot in the base. Once pushed in, the tab cannot be pulled back out unless broken indicating that the device became unlocked.

In one embodiment, the container could contain magnifying areas strategically placed to enhance the readability of bar codes, identification codes, expiration dates and other important data relating to the housed medicines.

DETAILED DESCRIPTION

Figure 1:
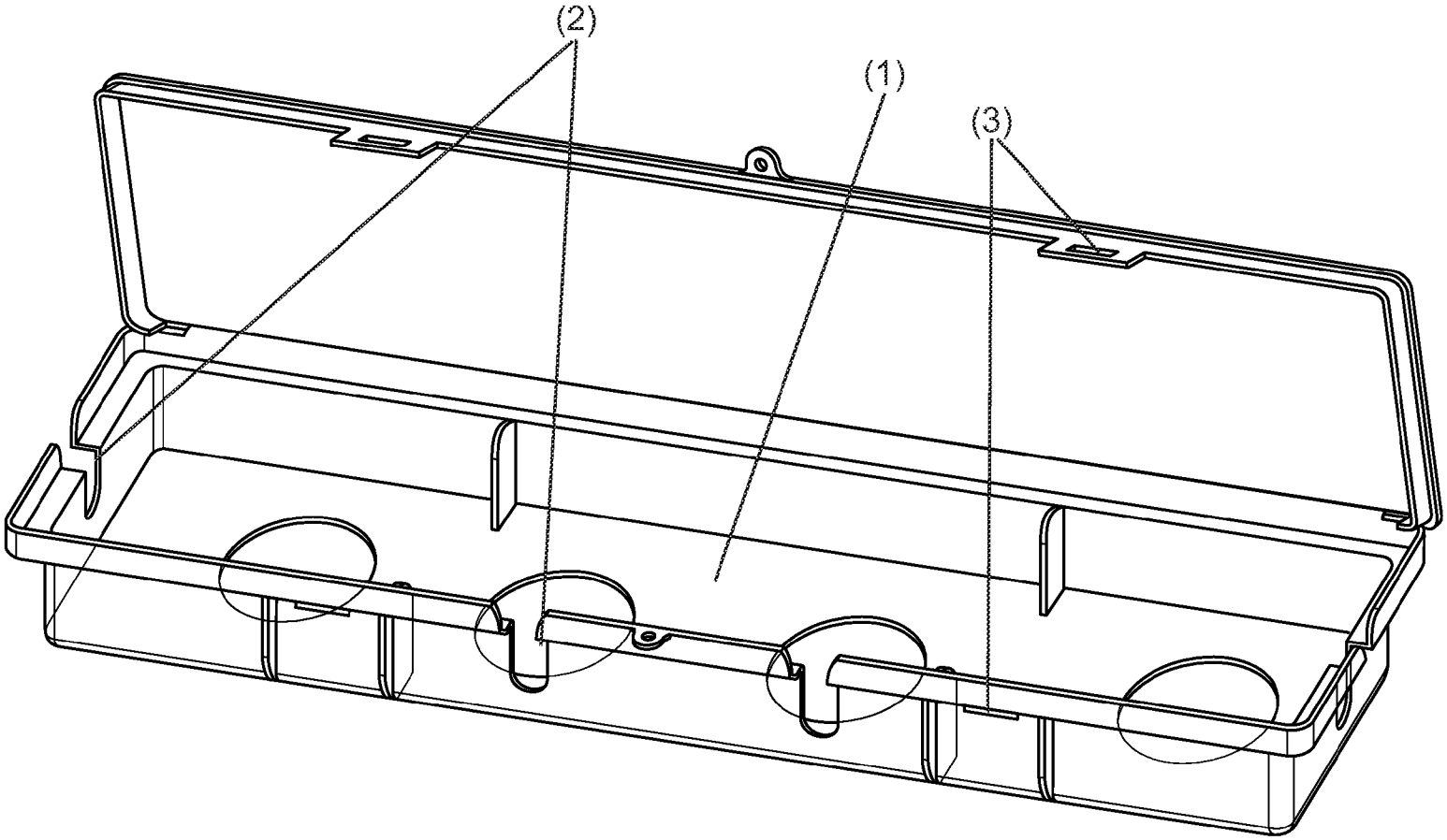
FIG. 1 depicts a view of one embodiment of an open container of the storage device of the present invention (1) showing cutouts (2) that would secure medicine vials and slots (3) for locking the container.
Figure 2:
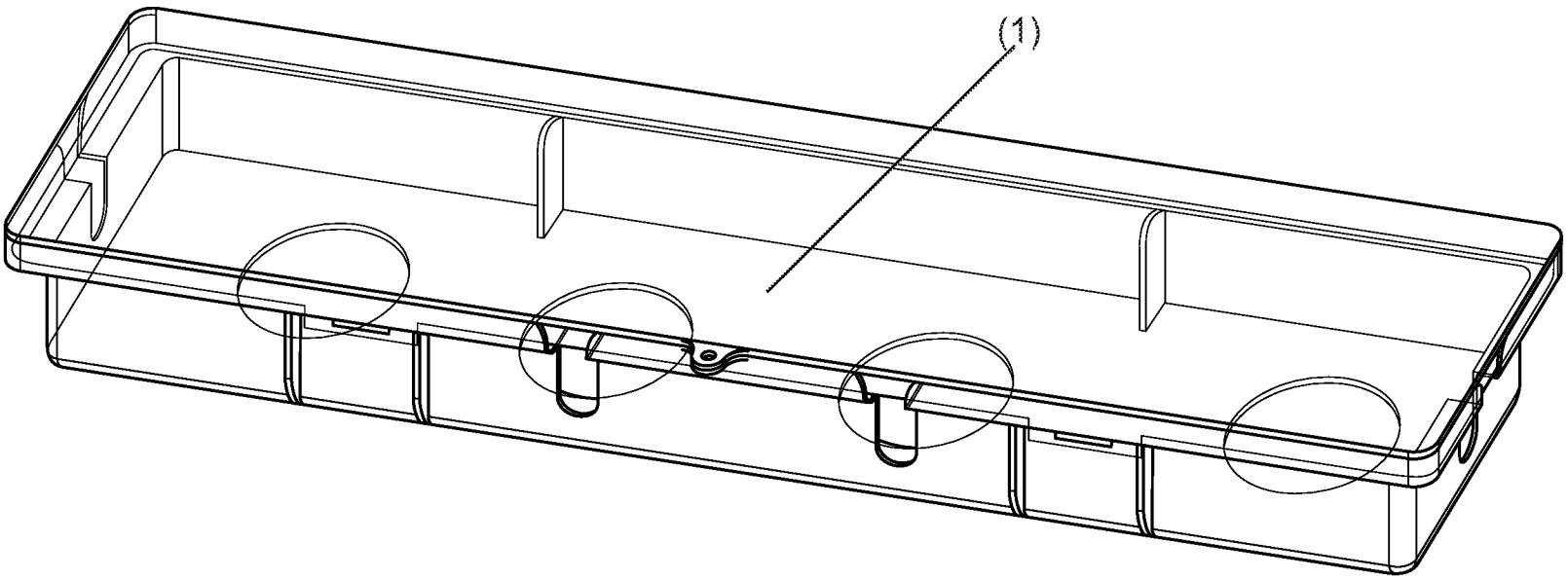
FIG. 2 depicts a view of one embodiment of the container of the storage device of the present invention (1) in the closed position (but without any medicine vials in place).
Figure 3:
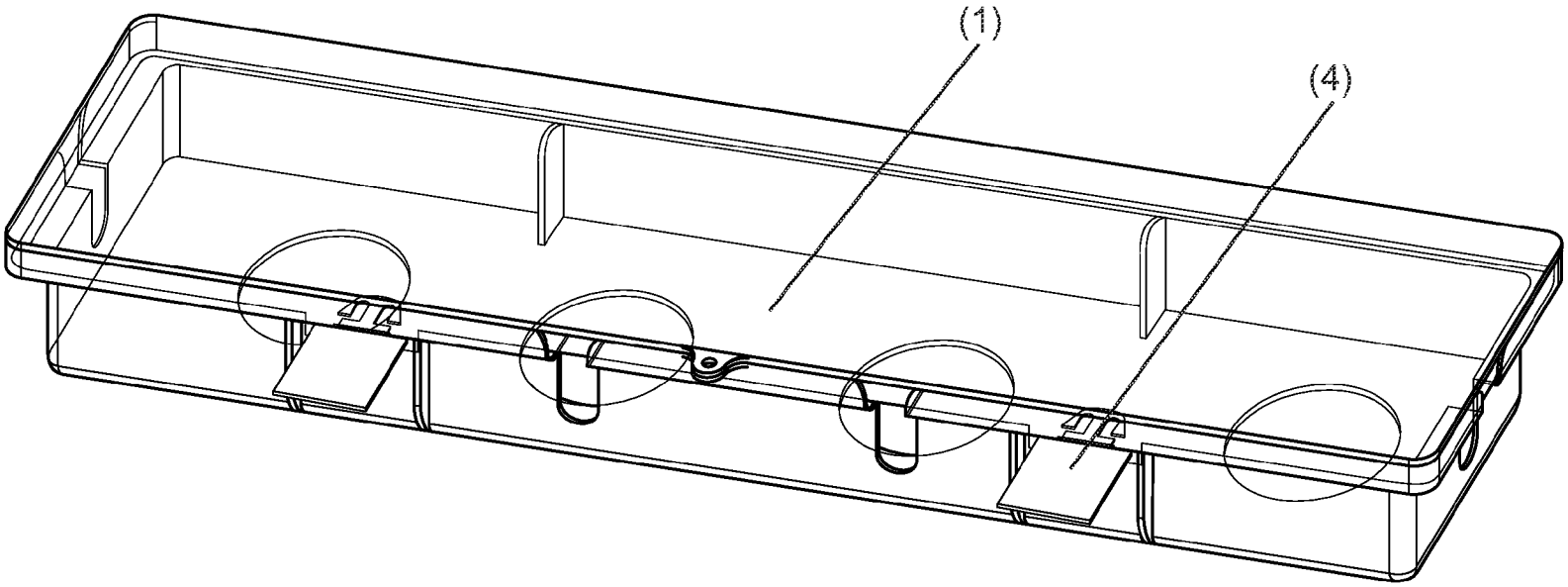
FIG. 3 depicts a view of one embodiment of the container of the storage device of the present invention (1) in the closed position (but without any medicine vials in place) and demonstrating the push in locking tabs (4).
Figure 4:
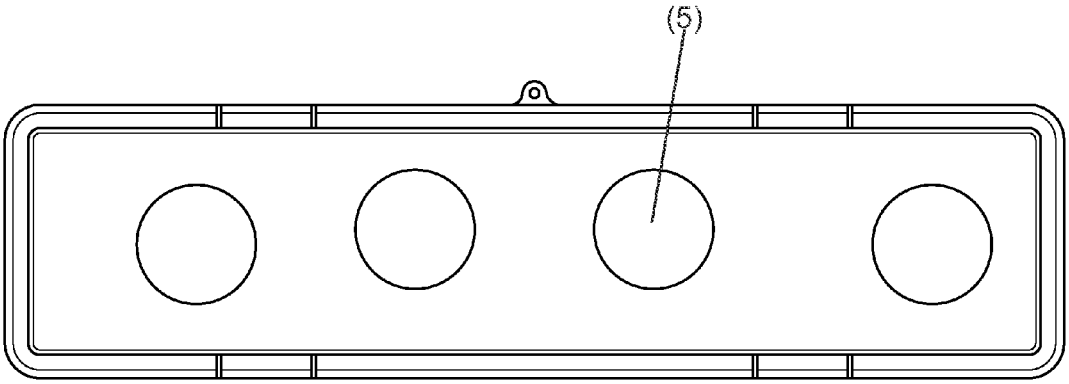
FIG. 4 depicts a view of one embodiment of the present invention showing the underside of the container where cutouts (5) could be to expose bar codes on medicine vials.
Figure 5:
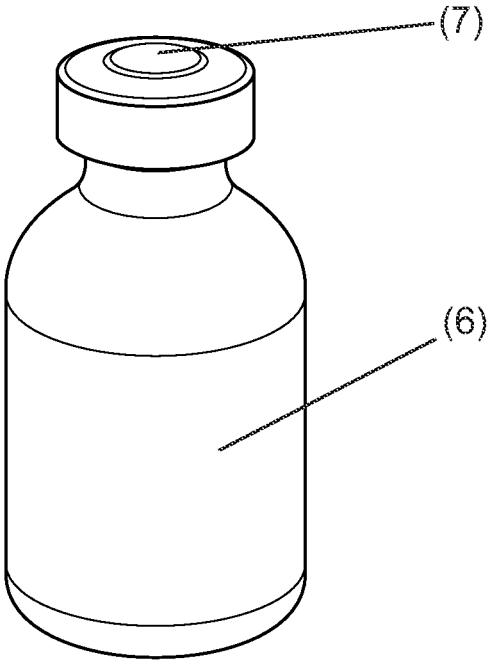
FIG. 5 depicts a typical multi-dose vial (6) of medicine that would typically be housed in the container of the present invention (existing art) with its mouth having an access port (7) to pull medicine.
Figure 6:
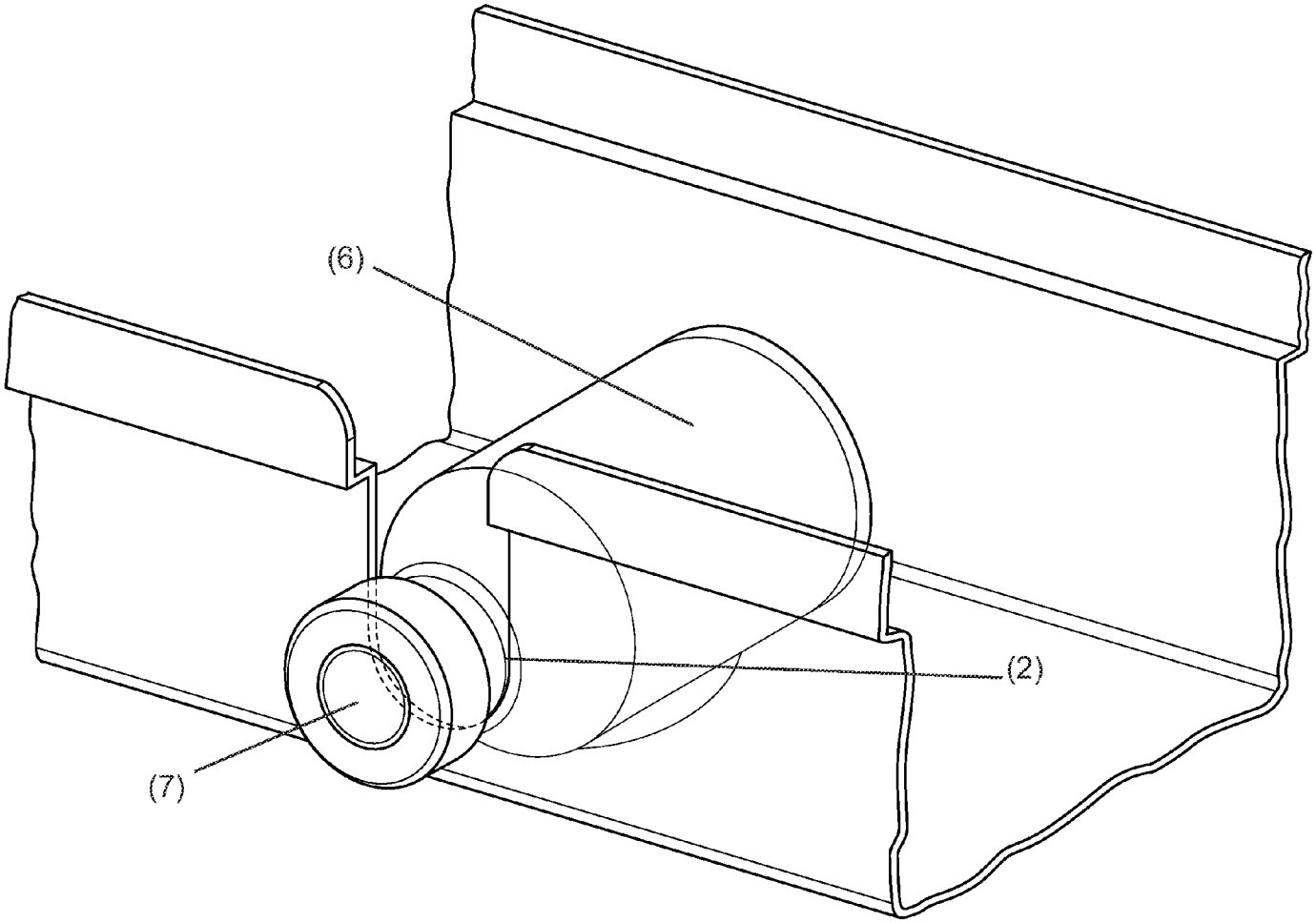
FIG. 6 depicts a view of one embodiment of the present invention showing how the neck of the vial (6) is slipped into a cutout (2) in the sidewall of the container exposing the access mouth (7) of said vial on the outside of the container.
Figure 7:
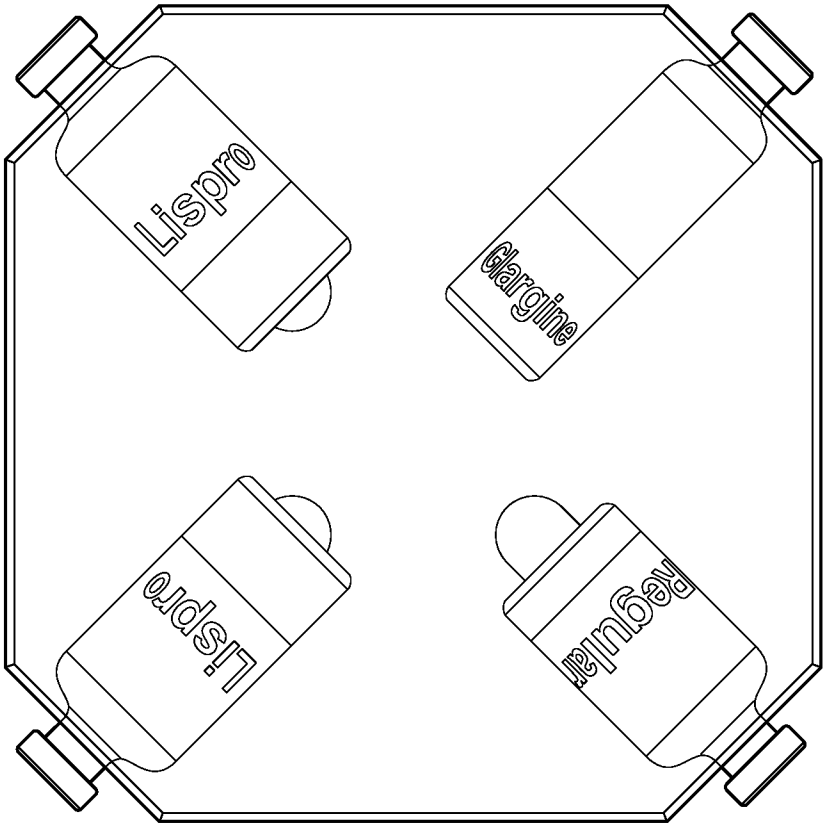
FIG. 7 depicts a view of one embodiment of the present invention showing a substantially square configuration of the container.
Figure 8:
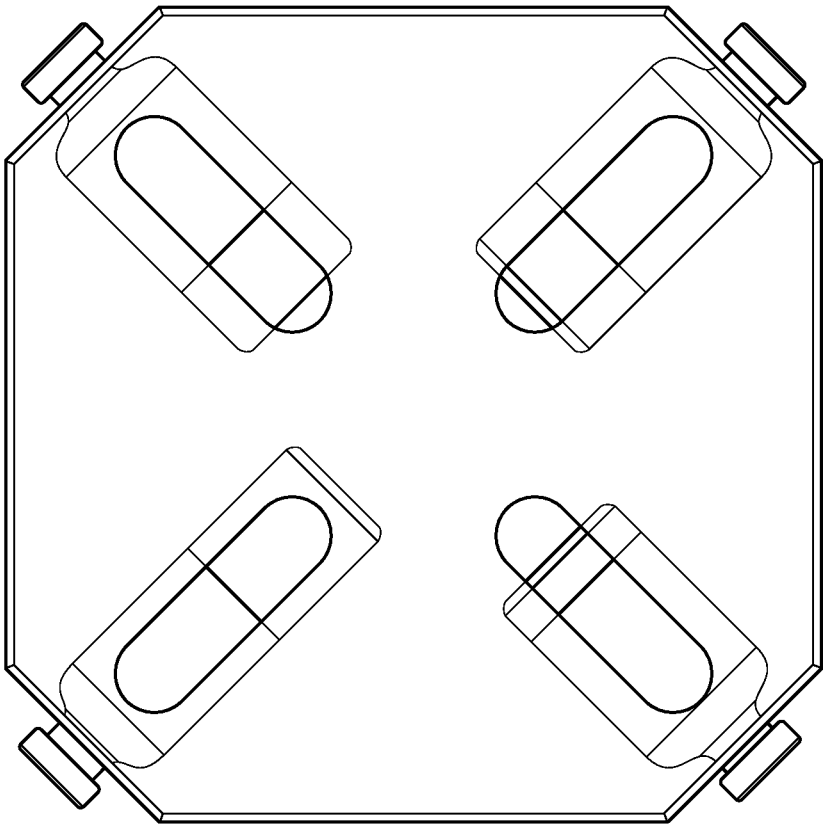
FIG. 8 depicts a view of one embodiment of the present invention showing the layout of cutouts on underside of the substantially square configuration to expose bar codes on medicine vials.
Figure 9:
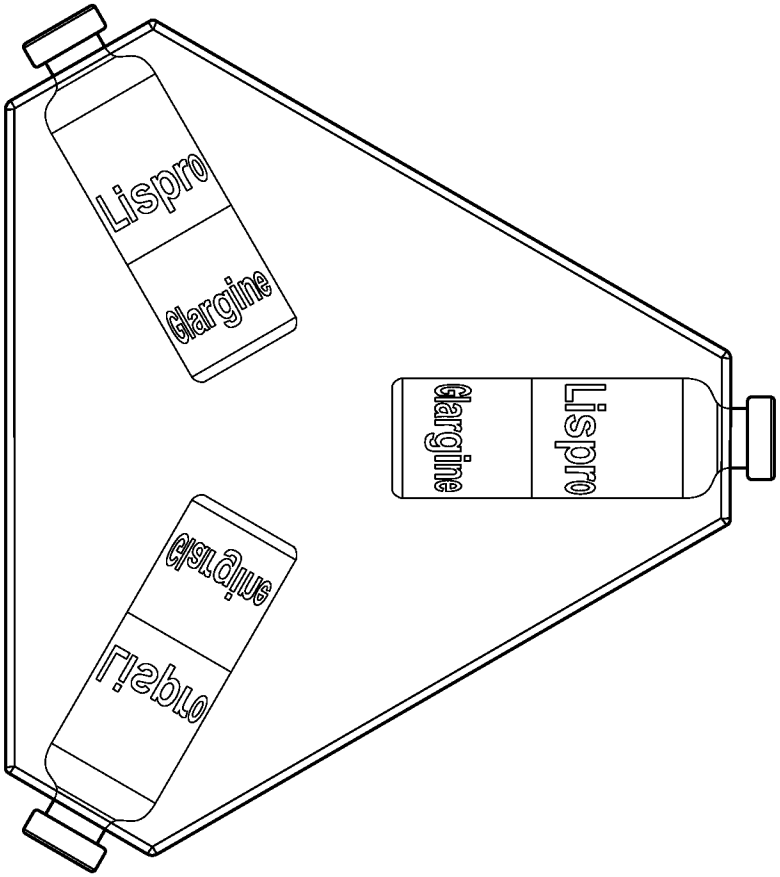
FIG. 9 depicts a view of one embodiment of the present invention showing a substantially triangular configuration of the container.
Figure 10:
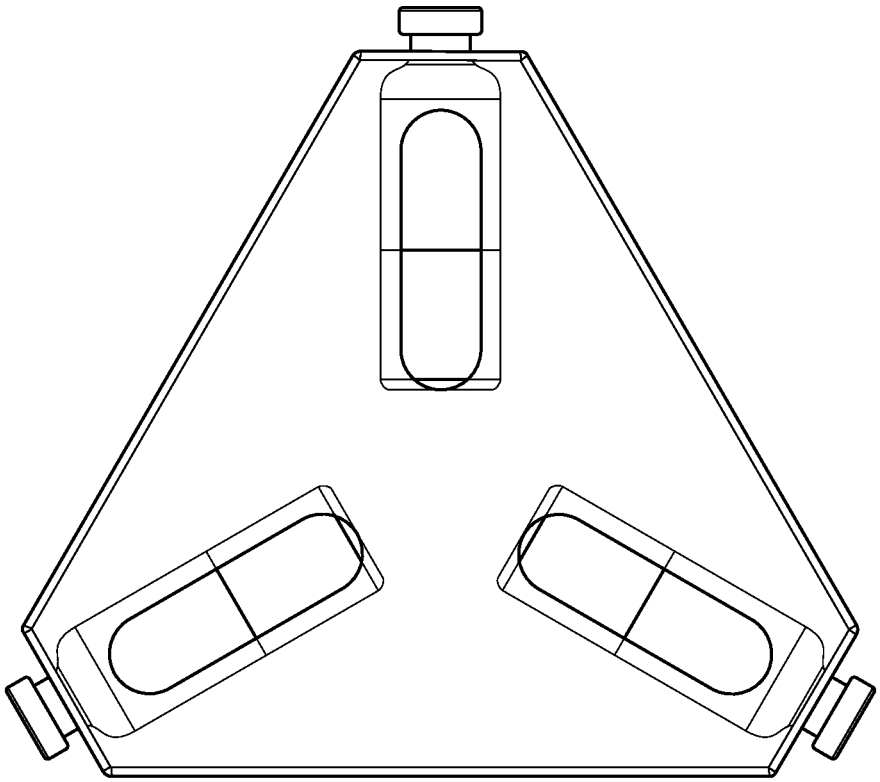
FIG. 10 depicts a view of one embodiment of the present invention showing the layout of cutouts on underside of the substantially triangular configuration to expose bar codes on medicine vials.

For clarity of disclosure, and not by way of limitation, the detailed description of the invention is divided into the following subsections that describe or illustrate certain features, embodiments or applications of the present invention.

DEFINITIONS

"Medicine vial" as used herein refers to any container typically used in health care to contain a liquid medication delivered through a syringe that contains an access port capable of allowing direct access for a syringe to extract medication for multiple uses.

"The Joint Commission" as used herein refers to the independent not-for-profit organization that accredits and certifies health care organizations and programs and is recognized nationwide as a symbol of quality regarding a health care organization's commitment to meeting certain performance standards.

"Multi-dose vial" as used herein refers to a medicine vial that contains an injectable liquid medication and contains a plurality of doses of said medication and is approved by the Food and Drug Administration ("FDA") for use with multiple persons.

"Access port" as used herein refers to that portion of the cap of a medicine vial containing a material allowing a needle of a syringe to push through for medication extraction and remain intact following needle piercing and medication extraction.

The Device of the Present Invention

In one embodiment the present invention provides a device comprising a lockable storage container capable of holding a plurality of multi-dose vials wherein like medications are oriented in a same direction and different medications are oriented in a different direction; identity of the medication (including a barcode) is readily perceptible; expiration date of the medication is readily perceptible and exposure to the access port of the medication is readily available all while the storage container remains locked securing all medications contained therein.

In one embodiment, the device of the present invention provides a method for hospitals to provide nursing stations with a plurality of commonly used multi-dose vial medications such that efficiency and security is enhanced.

In one embodiment, a commonly used multi-dose vial medication in hospital settings is insulin. There are five main types of insulin, with three being more commonly used, namely, insulin lispro (commonly sold under the brand HumaLOG), insulin glargine (commonly sold under the brand Lantus) and regular insulin (commonly sold under the brand HumulinR). Patients requiring insulin merely need a sterile dose of the insulin of the type they require, they do not necessarily need their own specific vial of such medication. So long as a sterile syringe is being inserted into a particular multi-dose vial of insulin to pull a dose, that same vial is still suitable for a different patient requiring the same type of insulin to provide their dose (assuming a full dose remains inside). Thus, a more efficient manner to provide insulin to patients in a hospital setting than is currently typically used (i.e., providing each patient with a vial of the type insulin they require even if their stay is short and a full vial is unlikely to be used; or providing a new vial if the existing vial is lost or becomes untrustworthy due to unreadable labeling) is to provide a "nurse's supply" of multi-dose vials of insulin that can be a community supply for all patients so long as, the supply remains sterile, contains the types of insulin required by the population of the community and doses given to patients can be monitored and recorded efficiently and effectively and securely. The present invention accomplishes this more efficient and safe manner of providing medication. Without this device, attempts to create a "nurse's supply" would simply be to supply the nurse's station with multi-dose vials and it would be up to the individuals running the station to implement procedure to track usage of vials, storage of vials and maintain an accurate and secure inventory.

The device of the present invention can house any number of medicine vials securely labeled and with protections from the labeling becoming obscured or unreadable that do not presently exist and providing such medicine vials in a manner that the medicine can be retrieved for dosing in a sterile manner with a bar code that can be scanned and inputted into specific patient files such that the instant dosing can be recorded safely and securely.

Examples

The present invention is further illustrated, but not limited by, the following examples.

The Joint Commission, in collaboration with other stakeholders, strives to improve health care for the public by evaluating health care organizations and providing standards, accreditation and certification. One such standard is that health care organizations should immediately discard any medication or solution found unlabeled.

The Joint Commission also provides that multi-dose vials are to be discarded 28 days after first use unless the manufacturer specifies otherwise (shorter or longer). Additionally, Standard MM.03.01.01, EP 7 requires that all stored medications are labeled with the expiration date. However, once the vial cap is removed or the vial is punctured, the manufacturer's expiration date is no longer valid and organizations must re-label multi-dose vials with a revised expiration date. If sterility is questioned or compromised, the multi-dose vial should be discarded regardless of expiration date.

Compliance with the foregoing can be cumbersome in a situation where many multi-dose vials of the same type of medication are stored for various patients. This has commonly been the case with insulin in hospital settings. For example, in one hospital area, there could be fifty patients, twenty of whom require some type of insulin. Of the twenty, perhaps thirteen require insulin lispro (commonly sold under the brand humaLOG), four require insulin glargine (commonly sold under the brand Lantus) and three require regular insulin (commonly sold under the brand HumulinR). This could be accomplished by having 20 separate multi-dose vials on the nurse's station, each with their own labeling, expiration date, patient name, etc. In an effort to streamline, there could be less than twenty, omitting the specific patient name; but, in that case it will be cumbersome to keep track of individual loose vials and which one should be used in any given dosing. Each patient has a variable discharge date. Some patients may require only one or two doses while others could require ten or more during a stay. It is highly unlikely that a significant number of the multi-dose vials will be efficiently used up. Moreover, the vials will get jostled about as a nurse practitioner looks for the specific multi-dose vial of the patient needed at a given time. The multi-dose vial will then be removed from the storage area, brought to the patient room, the medication administered and then returned (in the best of circumstances). Interruptions will occur and the medication may reside temporarily in a nurse's coat or a medicine cart. During this time, labels can get scraped or nicked such that expiration dates may become unreadable. According to The Joint Commission, in this case, the vial must be discarded.

According to safe injection practices, The Joint Commission and the United States Food and Drug Administration approves multi-dose vials for use on multiple persons so long as a new, sterile needle and syringe is used to access the medication in each instance of use. This is actually no different than required when used with the same person. Thus, multi-dose vials of insulin can be used across patients requiring the same type of insulin.

The device of the present invention provides a community supply of the more common types of insulin in a manner such that expiration date labels will not get nicked or scraped, the vials will not get jostled about or lost and it is irrelevant when a patient is discharged. When a patient requires a dose of insulin, the nurse can access the device of the present invention housing a community supply of insulin, readily see the expiration date to insure that a fresh supply is about to be administered, and the bar code can be scanned into the patient file to log the time and dose being administered. Then a fresh needle and syringe pulls the dose and administered to the patient and the community supply remains available and secure for the next patient. Because the multi-use vials are secure and easily viewable, efficiency and safety are enhanced. Because there are no loose vials, they do not get jostled about or lost. At the time any type of stocked insulin within the device is exhausted (either because it is finished or expired), the entire supply can be sent back to the pharmacy for restocking and inventory, replacing only those multi-use vials as necessary or desirable.

The device of the present invention could be appropriately sized to house as many vials of as many different types of medications as practicable under the circumstances. In one hospital setting, a kit with four multi-use vials, two of insulin lispro (commonly sold under the brand humaLOG) 3 ml each; one of insulin glargine (commonly sold under the brand Lantus) 10 ml each; and one of regular insulin (commonly sold under the brand HumulinR) 3 ml each and all of the foregoing with 100 units per ml may prove efficient. Each of the types of insulin are oriented in a different direction and in a different area of the kit to easily insure the proper type is administered each use and there is no confusion.

In another example, the device of the present invention could be configured in a triangular orientation with three multi-use vials, each vial extending out in a different direction. This could be done with all the same type of multi-use vial medication in situations where such vials are typically used up very quickly. In this circumstance, the device effectively renders a larger size such multi-use vial and safely and securely stores the vials. Or, there could be three different types of multi-use vial medications that are all commonly used among patients of a given hospital area. In this circumstance, the vials are safely and securely stored and removes the issue of lost or jostled vials and the need to replenish merely because vials become lost or unreadable.

One of skill in the art will appreciate that an infinite number of size and shape orientations are possible according to the needs of a particular circumstance where the goals of securely and safely storing and administering medication from multi-use vials is accomplished. This will naturally depend on the number and types of medications required and the sizes of the multi-use vials such medications are manufactured and delivered in. The salient features of: storing the multi-use vials in a particular orientation within the device; accessibility to identification and expiration dates; accessibility of the mouth or draw port of the vial; and locking of the container once loaded will all be accomplished no matter the size and shape of the device.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

Each and every feature described herein, and each and every combination of two or more of such features, is included within the scope of the present invention provided that the features included in such a combination are not mutually exclusive.

What is claimed is:

1. A storage container comprising a body comprising sidewalls connected together forming an enclosure defining a cross-sectional shape, a top with structure to open and close the top, and corresponding to substantially the same cross-sectional shape of the defined enclosure, a bottom corresponding to substantially the same cross-sectional shape of the defined enclosure and a means for locking the top in the closed position wherein said storage container is configured to hold a plurality of medicine vials wherein:

a. the sidewalls further comprise cutouts that each correspond to the cross-sectional shape of a neck of one of the medicine vials such that the medicine vial may be secured by placing the neck of the vial into one said cutout; and b. the bottom further comprises cutouts that each correspond to the shape and size of the side of one of the medicine vials such that the identity of the medicine vials would be exposed by the bottom cutouts when the vials are secured into the storage container.

2. The storage container of claim 1, wherein said storage container is made from a clear material.

3. The storage container of claim 1, wherein said storage container is substantially rectangular approximately 8½ inches by 2 inches by 1 inch.

4. The storage container of claim 3 wherein said storage container is fitted to house four medicine vials.

5. The storage container of claim 1 further comprising openings in the body and corresponding openings in the top wherein when the top is closed said openings in the body and said corresponding openings in the top are aligned and further where said locking means is constitute single use breakaway tabs that can be inserted into the aligned openings.

6. The storage container of claim 1 further comprising one or more tabs on said top and corresponding mating means on said body that align with each of said corresponding tabs during closure such that when closed said tabs aligned with said mating means are capable of accepting said locking means for securing said storage container in the closed position.

7. The storage container of claim 1 further comprising clear physical closures of said bottom cutouts that constitute view areas capable of exposing identity and expiration dates of any inserted medicine vials.

8. The storage container of claim 7 wherein said clear physical closures of said bottom cutouts contain magnification.

9. The storage container of claim 1 wherein said storage container is configured to a size and shape to optimally house the plurality of medicine vials wherein all vials containing the same type of medicine are oriented in the same direction and all vials containing a different type of medicine than any other are oriented in a different direction.

10. A method of drug administration comprising the steps of:

obtaining a storage container comprising a body comprising sidewalls connected together forming an enclosure, a top corresponding to substantially the same cross-sectional shape of the defined enclosure with structure to open and close the top, and a bottom corresponding to substantially the same cross-sectional shape of the defined enclosure and a means for locking the top in the closed position wherein said storage container is configured to hold a plurality of medicine vials wherein the sidewalls further comprise cutouts that each correspond to the cross-sectional shape of a neck of one of the medicine vials such that the medicine vial may be secured by placing the neck of the vial into one said cutout; and the bottom further comprises cutouts that each correspond to the shape and size of the side of one of the medicine vials such that the identity of the medicine vials would be exposed by the bottom cutouts when the vials are secured into the storage container;

securing the plurality of medicine vials in said storage container;

locking said storage container containing the plurality of medicine vials;

storing said storage container containing the plurality of medicine vials in an area where medicine contained in the vials is needed;

retrieving said storage container and administering said medicine contained in said storage container; and re-storing said storage container back to the area where said medicine is needed.

11. The method of claim 10 wherein when securing a plurality of medicine vials, said securing is performed in a manner where all like vials of medicine are oriented in the same direction and all dissimilar vials of medicine are oriented in a different direction.

* * * * *